US006918436B2

(12) United States Patent
Kaspar et al.

(10) Patent No.: US 6,918,436 B2
(45) **Date of Patent: *Jul. 19, 2005**

(54) BRAZED CONDENSER FOR AN AIR CONDITIONER

(75) Inventors: Martin Kaspar, Esslingen (DE); Kurt Molt, Bietighein-Bissingen (DE)

(73) Assignee: Behr GmbH & Co., Stuttgart (DE)

( * ) Notice: Subject to any disclaimer, the term of this patent is extended or adjusted under 35 U.S.C. 154(b) by 26 days.

This patent is subject to a terminal disclaimer.

(21) Appl. No.: 10/621,614

(22) Filed: Jul. 18, 2003

(65) Prior Publication Data

US 2004/0104019 A1 Jun. 3, 2004

Related U.S. Application Data

(62) Division of application No. 10/162,680, filed on Jun. 6, 2002, now Pat. No. 6,629,560, which is a continuation of application No. 09/425,613, filed on Oct. 22, 1999, now Pat. No. 6,446,714.

(30) Foreign Application Priority Data

Oct. 22, 1998 (DE) ..... 198 48 744

(51) Int. Cl.[7] ..... F28F 9/02; B21D 53/02; B23K 31/00

(52) U.S. Cl. ..... 165/175; 165/173; 165/913; 62/512; 29/890.054; 228/175

(58) Field of Search ..... 165/41, 154, 155, 165/132, 173, 174, 175, 176, 177, 153, 110, 148, 913, DIG. 476; 29/890.054; 228/175; 62/509, 512

(56) References Cited

U.S. PATENT DOCUMENTS 3,411,196 A * 11/1968 Zehnder ..... 228/175
3,689,972 A * 9/1972 Mosier et al.
3,768,148 A * 10/1973 Pagnotta et al. ..... 228/175 X
3,985,282 A * 10/1976 Miller et al. ..... 228/175
4,043,500 A * 8/1977 Padden et al. ..... 228/175

(Continued)

FOREIGN PATENT DOCUMENTS

DE 41 06297 A1 * 9/1992
DE 43 19 293 12/1994

(Continued)

OTHER PUBLICATIONS

US 6,068,049, 5/2000, Hoger (withdrawn)*

Patent Abstracts of Japan, Publication No. 09206949, Nakano Akio, "Tack Welding Method Before Brazing", published Aug. 12, 1997.

(Continued)

*Primary Examiner*—Ljiljana Ciric
(74) *Attorney, Agent, or Firm*—Crowell & Moring LLP

(57) ABSTRACT

In a brazed condenser for an air conditioner, a collecting tube connected with a collector is prefabricated as a one-piece tube. The collecting tube is connected by tack weld seams with the collector before brazing the collecting tube and the collector together.

11 Claims, 2 Drawing Sheets

U.S. PATENT DOCUMENTS

| | | | | | |
|---|---|---|---|---|---|
| 4,497,428 | A | * | 2/1985 | Baumann | 228/175 |
| 4,509,672 | A | * | 4/1985 | Woodhull, Jr. et al. | 228/175 |
| 5,036,913 | A | * | 8/1991 | Murphy et al. | 165/173 |
| 5,088,294 | A | * | 2/1992 | Ando | 62/509 X |
| 5,159,821 | A | | 11/1992 | Nakamura | 62/509 |
| 5,407,004 | A | * | 4/1995 | DeRisi et al. | 228/175 X |
| 5,419,141 | A | | 5/1995 | Burk | 62/474 |
| 5,423,564 | A | * | 6/1995 | Harvey | 228/175 X |
| RE35,098 | E | * | 11/1995 | Saperstein | 29/890.054 X |
| 5,537,839 | A | * | 7/1996 | Burk et al. | 62/509 X |
| 5,546,761 | A | * | 8/1996 | Matsuo et al. | 62/509 |
| 5,582,027 | A | | 12/1996 | Baba et al. | 62/509 |
| 5,592,830 | A | | 1/1997 | Baba et al. | 62/509 |
| 5,628,206 | A | | 5/1997 | Baba | 62/507 |
| 5,645,127 | A | * | 7/1997 | Enderle et al. | 165/175 X |
| 5,666,791 | A | | 9/1997 | Burk | 62/474 |
| 5,669,440 | A | * | 9/1997 | Bauer et al. | 165/177 |
| 5,713,217 | A | | 2/1998 | Baba | 62/509 |
| 5,761,808 | A | * | 6/1998 | Patel et al. | 29/890.054 X |
| 5,765,633 | A | * | 6/1998 | Hu | 165/176 X |
| 5,875,650 | A | * | 3/1999 | Nobuta et al. | 165/110 X |
| 5,927,102 | A | * | 7/1999 | Matsuo et al. | 62/509 |
| 5,946,938 | A | * | 9/1999 | Balthazard | 62/509 X |
| 5,946,940 | A | * | 9/1999 | Inoue | 62/512 X |
| 5,992,174 | A | * | 11/1999 | Mittelstrass | 62/512 X |
| 6,052,899 | A | * | 4/2000 | Inaba | 29/890.054 X |
| 6,223,556 | B1 | * | 5/2001 | De Keuster et al. | 62/509 |

FOREIGN PATENT DOCUMENTS

| | | | | |
|---|---|---|---|---|
| DE | 195 36 999 | | 4/1996 | |
| EP | 0 669 506 | | 8/1995 | |
| EP | 0 689 014 | | 12/1995 | |
| EP | 0 795 730 | A1 | 9/1997 | |
| FR | 2 754 595 | A1 * | 4/1998 | |
| JP | 2-121769 | * | 5/1990 | 228/175 |
| JP | 3-216275 | * | 9/1991 | 228/175 |
| JP | 4-143066 | * | 5/1992 | |
| JP | 4-320771 | * | 11/1992 | 62/509 |
| JP | 8-94330 | * | 4/1994 | 62/509 |
| JP | 11-320097 | * | 11/1999 | |

OTHER PUBLICATIONS

Patent Abstracts of Japan, Publication No. 08099170, Yamane Teruo, "Manufacture of Heat Exchanger Providing Bracket", published Apr. 16, 1996 with Database XP–002154754.

* cited by examiner 12
26
II
II
20
11
29
14
10
13
15
III
16
III
13
19
18
17
24
12
25

22
20
22
19
15
14

23
19
15
23
21

BRAZED CONDENSER FOR AN AIR CONDITIONER

This application is a divisional of application Ser. No. 10/162,680, field Jun. 6, 2002 U.S. Pat. No. 6,629,560, which is a continuation of application Ser. No. 09/425,613, field Oct. 22, 1999, now U.S. Pat. No. 6,446,714.

This application claims the priority of German application 198 48 744.4, filed Oct. 22, 1998, the disclosure of which is expressly incorporated by reference herein.

BACKGROUND AND SUMMARY OF THE INVENTION

The present invention relates to a brazed condenser for an air conditioner, such as a motor vehicle air conditioner, having a block of tubes and fins arranged between two collecting tubes, and with a tube-shaped collector which is mounted laterally on one of the collecting tubes.

In one such condenser known from U.S. Pat. No. 5,159,821, the condenser is assembled and then brazed in a furnace. In order to hold the parts of the condenser together, particularly the collecting tube formed of two half shells, and also to connect this collecting tube with the tube-shaped collector, molds must be provided to hold the condenser in the preassembled condition until the condenser is brazed.

It is also known from German Patent Document DE 195 36 999 A1 to hold the two-part collecting tube together with a collector molded of a plane steel sheet bar, as a result of a plastic deformation of elements, such that they can be brazed to one another in a furnace.

It is also known from European Patent Documents EP 689 014 A1 and EP 0 669 506 A1 to provide an extruded tube as a collector which is provided on the outside with profile strips extending in the longitudinal direction and forming a collecting tube together with a half shell. These elements are also joined into a preassembly and are then brazed in a furnace. Joining must take place very carefully, while handling of the condenser during transport to the brazing furnace must also be carried out very carefully so that the parts do not slide with respect to one another; this could impair tight soldering.

It is an object of the invention to simplify a condenser of the initially mentioned type, particularly with respect to the design of the collecting tube and the collector, and to ensure that these parts are also securely connected with one another before brazing in a brazing furnace.

This object is achieved by prefabricating the collecting tube as a one-piece tube which is connected with the collector by tack weld seams.

The use of a one-piece collecting tube is advantageous since the tube already has its final shape so that no parts can be displaced with respect to one another. Furthermore, tack weld seams can be made in a simple manner between the one-piece collecting tube and the collector and provide sufficient stability until final brazing-together.

In an advantageous further development of the invention, the tack weld seams are constructed as laser weld seams. Such laser weld seams have the advantage that the introduction of heat into the collector and into the collecting tube is relatively low so that thermal deformations which may impair subsequent tight brazing are not to be expected.

In a further development of the invention, at least one of the tubes is provided with a plastic deformation for forming a contact surface for the other tube. In an advantageous further development, at least one connection opening between the two tubes is provided in the area of the deformation. Flat contact in the area of the plastic deformation ensures that the area of the connection openings is reliably tightly brazed toward the outside.

In a first embodiment of the invention, the tube of the collector is extended by a coaxial tube piece which is provided on the outside with a longitudinal groove forming a contact surface for the collecting tube. The use of such a coaxial tube piece permits the provision of a secure contact surface. In a further development, the coaxial tube piece is provided with an internal thread for receiving a plug. The coaxial tube piece, therefore, also functions to make a sufficient wall thickness available for providing an internal thread for a plug.

Additional characteristics and advantages of the invention will be clear from the following description of the embodiments illustrated in the drawings.

DESCRIPTION OF THE PREFERRED EMBODIMENTS

Figure 1:
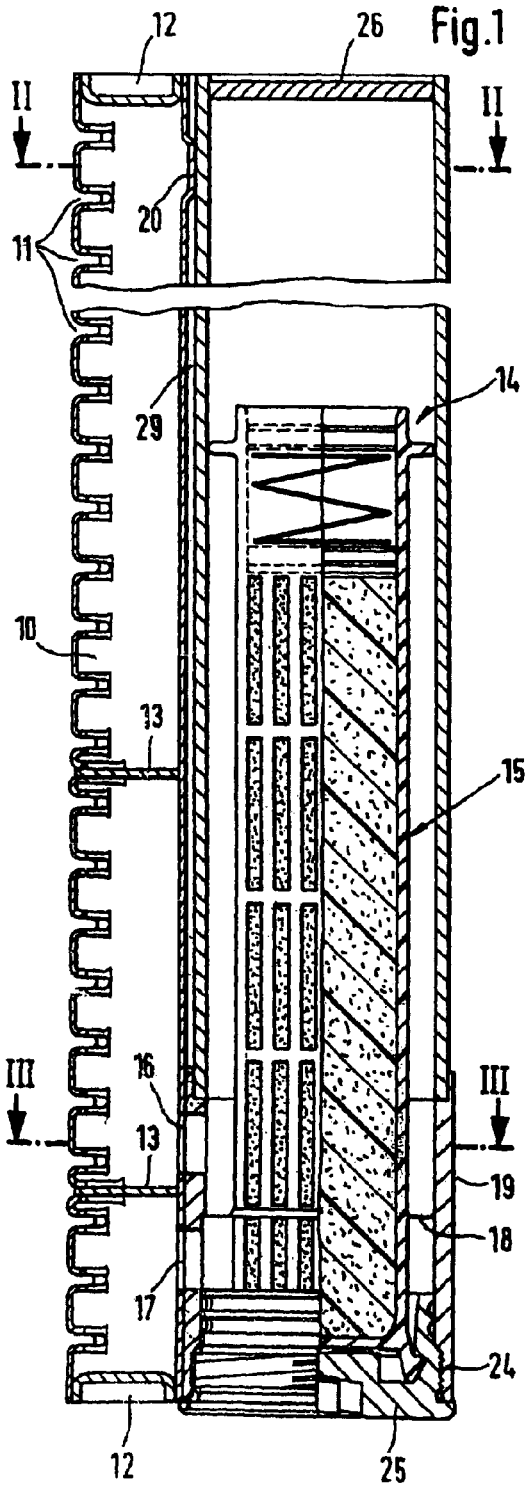
FIG. 1 is an axial sectional view of a collecting tube and a collector of a brazed condenser.
Figure 2:
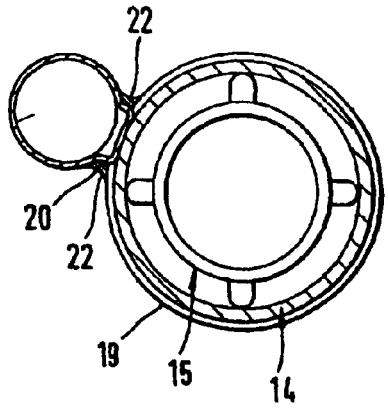
FIG. 2 is a sectional view along line II—II of FIG. 1.

A condenser, which is only partially shown in FIG. 1, has a collecting tube 10 which is a one-piece, preferably welded round tube. The collecting tube 10 is provided at regular distances with passages 11 which are used for accommodating flat tubes. Normally, so-called corrugated fin plates are arranged between the flat tubes in a block B of tubes and tins, which is partially schematically shown in phantom in FIG. 1. The opposite ends of the flat tubes, which are not shown, are fitted into passages of a mirror-invertedly arranged collecting tube. On the top and on the bottom, the collecting tube 10 is closed by closing lids 12 which are inserted in a force-locking manner. At defined distances, the collecting tube 10 is provided in the axial direction with partitions 13. Additional partitions are also assigned (at different axial distances) to the opposite collecting tube, which is not shown. These additional partitions, in connection with the partitions 13, cause the refrigerant to flow through the condenser in a meandering manner.

The flat tubes, the corrugated fins, the collecting tubes 10, the partitions 13 and the lids 12 are plated with a material appropriate for brazing so that they can be brazed to one another in a furnace, particularly by way of what is known as the NOCOLOK process. Next to the collecting tube 10, and parallel thereto, a collector 14 is arranged which receives a cartridge 15 which contains dryer granulates and, in addition, acts as a filter screen. Between the collecting tube 10 and the collector 14, connection openings 16, 17 are provided above and below the lowest partition 13. Between the two openings, the cartridge 15 is provided with a sealing ring 18 resting on the inside against the collector 14, so that the refrigerant, which is already virtually completely liquified in this area, will necessarily flow through the cartridge 15.

The collector 14 is formed by a round tube, such as a welded round tube, which is lengthened by means of a tube piece 19 in the area of its lower end.

In the area of its upper end, the collecting tube 10 is provided with a preferably hydraulically made recess 20 which extends over a relatively short axial length. This recess is rounded in a groove-shaped manner so that it forms a contact surface for the exterior side of the tube-shaped collector.

Figure 3:
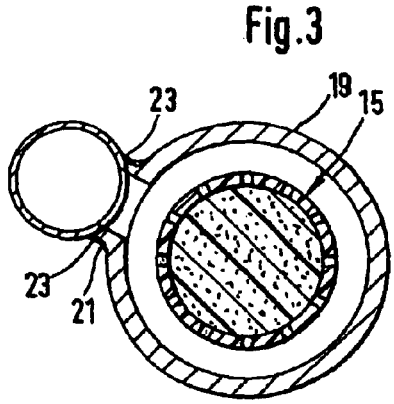
FIG. 3 is a sectional view along line III—III of FIG. 1.

The tube piece 19 has a larger outside diameter than the welded tube of the collector, onto the lower end of which the tube piece is pressed by way of a ring shoulder 19*a*. The tube piece 19 defines an extruded profile, as illustrated particularly in FIG. 3. On its exterior side, the tube piece has a longitudinal rib 21 which forms an external longitudinal groove the outside of which is adapted to the outer circumference of the collecting tube 10. The radial depth of the recess 20 and the radial dimension of the tube piece 19 and of the longitudinal rib 21 are coordinated with one another such that the collecting tube 10 is arranged parallel to the tube-shaped collector, in which case the collecting tube rests flatly in the area of the recess 20 and in the area of the longitudinal rib 21. In this manner, an insulating air gap 29 is left along the predominant length of the collector 14 and the collecting tube 10. As a result, heat transmission from the condenser to the collector 14 is limited so that it is less likely that, because of such heat transport, already liquid refrigerant will be evaporated again in the collector 14. This insulation can still be improved if the air gap 29 is filled with heat-insulating material, such as glass fiber mats.

The collecting tube 10 and the collector 14 are placed on one another and aligned in a clamping device. They are then connected with one another by tack weld seams 22, 23 in the area of the recess 20 and in the area of the longitudinal rib 21, which preferably consist of short laser weld seams or TIG seams. Subsequently, the collector 14 and the collecting tube 10 are fixedly connected with one another such that they can easily be removed from the clamping device and transported to a brazing furnace.

At its lower end, the tube piece 19 is provided with an internal thread 24 into which a plug 25 is screwed which has a corresponding external thread. The cartridge 15 is locked with this plug 25 so that, after releasing the plug, it can be pulled out of the collector 14 and also does not move upwards during normal operation within the collector 14. The upper end of the collector 14 is closed by a brazed-in closing lid 26. The collector 14 and the tube piece 19 are plated with a material appropriate for brazing like the collecting tube 10 so that tight brazing is achieved in a brazing furnace, particularly in the area of the connection openings 16, 17.

Figure 4:
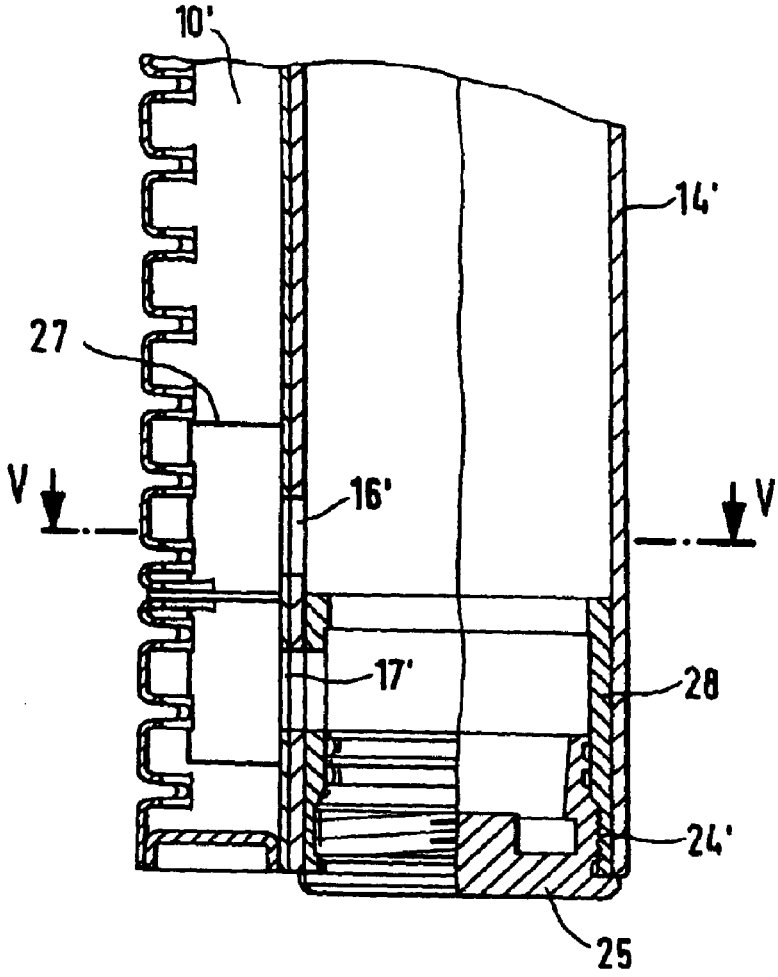
FIG. 4 is a partial axial sectional view of another embodiment of a collecting tube and of a collector of a condenser.
Figure 5:
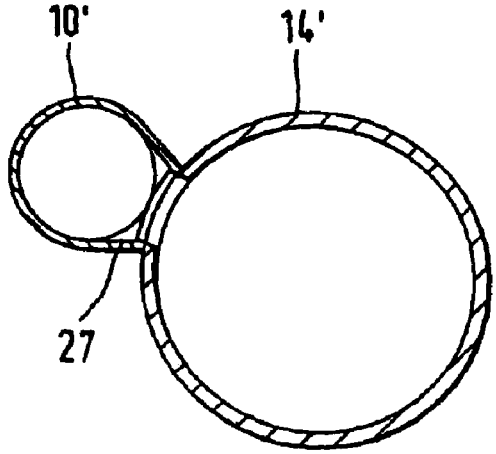
FIG. 5 is a sectional view along line V—V of FIG. 4.

In the embodiment according to FIGS. 4 and 5, the collector 14' has the form of a round tube which is continuous along its whole length and is preferably welded. The collecting tube 10' rests against this round tube of the collector 14' along a surface line. In the areas of the connection openings 16', 17', the collecting tube 10' is provided with a recess 27 which forms a longitudinal groove adapted to the outer contour of the collector 14'. In the area of this groove, the collecting tube 10' and the exterior tube 14' rest flatly against one another. Also in this embodiment, the collecting tube 10' and the collector 14' are joined in a clamping device and are aligned with respect to one another and are then tack-welded with one another by short laser weld seams or TIG seams. These laser weld seams may be provided at any point because the collecting tube 10' and the collector 14' contact one another along a surface line over the whole length.

A sleeve 28 is inserted into the lower end of the collector 14' and is later brazed in. The sleeve 28 is provided with an internal thread 24' into which a plug 25 can be screwed by its external thread.

In a modified embodiment, a longitudinal groove is recessed into the collecting tube 10' on the side facing away from the passages 11, which longitudinal groove is adapted to the outside diameter of the tube of the collector 14'. Since, in this case, the collector and the collecting tube also rest against one another, tack welding can also be established here in a simple manner by weld seams using laser welding before brazing.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A brazed condenser for an air conditioner comprising:

a block of tubes and fins, two collecting tubes between which said block is arranged, said collecting tubes comprising partitions, a tube-shaped collector which is mounted laterally with respect to one of the collecting tubes, two connection openings disposed between said tube-shaped collector and the one of the collecting tubes, tack-weld seams by which said one of the collecting tubes is connected with the tube-shaped collector, a cartridge acting as a filter screen contained in the tube-shaped collector, and a sealing ring provided between the two connection openings.

2. A brazed condenser according to claim 1, wherein the tack weld seams are TIG seams or laser weld seams.

3. A brazed condenser according to claim 2, wherein contact between said one of the collecting tubes and the tube-shaped collector is provided with at least one deformation in said one of the collecting tubes.

4. A brazed condenser according to claim 1, wherein contact between said one of the collecting tubes and the tube-shaped collector is provided by at least one deformation in said one of the collecting tubes.

5. A brazed condenser according to claim 4, wherein the deformation is a recess.

6. A brazed condenser according to claim 5, wherein the connection openings are provided at the deformation.

7. A brazed condenser according to claim 5, including an air gap along most of the length of said one of the collecting tubes between said one of the collecting tubes and the tube-shaped collector.

8. A brazed condenser according to claim 7, wherein the connection openings are provided at the deformation.

9. A brazed condenser according to claim 4, wherein said deformation is rounded to define a contact surface providing said contact between said one of the collecting tubes and the tube-shaped collector.

10. A brazed condenser according to claim 4, wherein the connection openings are provided at the deformation.

11. A brazed condenser according to claim 1, including an insulating air gap left along said one of the collecting tubes and the tube-shaped collector.

* * * * *